United States Patent [19]

Cook

[11] Patent Number: 5,042,090

[45] Date of Patent: Aug. 27, 1991

[54] PRIVACY NURSING BLANKET

[76] Inventor: Victoria L. Cook, 6969 Negrin Road, Lantzville, British Columbia, Canada, V0R 2H0

[21] Appl. No.: 586,003

[22] Filed: Sep. 21, 1990

[30] Foreign Application Priority Data

Sep. 28, 1989 [CA] Canada ..... 613838

[51] Int. Cl.[5] ..... A41B 13/06; A41D 11/00

[52] U.S. Cl. ..... 2/69; 2/104; 5/482; 5/486; 5/494

[58] Field of Search ..... 2/69, 69.5, 104, 84, 2/75, 80; 5/482, 486, 494

[56] References Cited

U.S. PATENT DOCUMENTS

| | | | |
|---|---|---|---|
| 1,454,541 | 5/1923 | Falvey | 2/69 |
| 1,646,792 | 10/1927 | Moore | 5/494 X |
| 1,704,504 | 3/1929 | Hedden | 2/69 |
| 1,723,644 | 8/1929 | Collingbourne | 2/69.5 |
| 2,150,486 | 3/1939 | Bjornson | 2/69.5 X |
| 2,151,462 | 3/1939 | Bulpit et al. | 2/69.5 X |
| 2,194,123 | 3/1940 | Neil | 5/494 X |
| 2,418,582 | 6/1947 | Stumpf | 2/74 |
| 2,620,475 | 9/1952 | Legg et al. | 2/50 |
| 4,396,227 | 8/1983 | Neilson | 5/482 X |
| 4,468,816 | 4/1984 | Kaufer | 2/104 |
| 4,579,753 | 4/1986 | Gjendemsjo | 2/69.5 X |
| 4,597,121 | 7/1986 | Bouma | 2/69 X |
| 4,631,754 | 3/1986 | Ryan | 2/104 |
| 4,712,251 | 12/1987 | Cobble | 2/49 |
| 4,773,101 | 9/1988 | Kapp et al. | 2/69.5 |
| 4,783,855 | 11/1988 | Njegovan | 2/69.5 |
| 4,964,172 | 10/1990 | Bollard | 2/104 |

FOREIGN PATENT DOCUMENTS

| | | | |
|---|---|---|---|
| 997069 | 12/1951 | France | 2/69.5 |
| 2084861 | 4/1982 | United Kingdom | 2/69 |

*Primary Examiner*—Werner H. Schroeder
*Assistant Examiner*—Jeanette E. Chapman
*Attorney, Agent, or Firm*—Shlesigner Arkwright Garvey

[57] ABSTRACT

The invention provides a blanket which can function not only as a blanket for keeping warm, but also as a blanket to provide privacy for a nursing mother to breast feed her baby in public and also as a sun shade and wind shade. The blanket has a periphery and an inner portion, and also a contracting structure for contracting the inner portion to form a hood means when contracted, the contracting means being spaced inwardly from the periphery. A margin extends between the contracting means and the periphery and is adapted to form gathers or folds extending from and around the hood means when the contracting means is contracted. The hood means receives the baby's head, and usuall most of the baby's torso. The gathers stiffen the margin of the blanket to be essentially self-supporting when extending from the hood means for leaning against the mother's upper body.

9 Claims, 2 Drawing Sheets

PRIVACY NURSING BLANKET

BACKGROUND OF THE INVENTION

The invention relates to a blanket for providing privacy for a mother who wishes to breastfeed her baby in public, and also for use as a blanket for keeping warm.

While breastfeeding a baby in public is common practice in many parts of the world, this practice is not common in Western Europe and North America. Specialized items or garments have been devised which permit the baby to nurse, while concealing the mother's upper body. Some garments tend to be awkward to use, and commonly are not flattering for the mother or baby and in some case obstruct the mother's view of the baby. Typical examples of garments worn by the mother are found in U.S. Pat. Nos. 4,631,754 to Ryan, 4,468816 to Kaufer and 4,712,251 to Cobble. Alternatively, the baby can wear an item of clothing which can also provide some coverage for the mother, for example a specialized baby's bonnet having a broad stiff detachable brim as found in U.S. Pat. No. 4,384,371 to Sonne.

The prior art garments or items are also considered to be unsatisfactory by the inventor as they can be awkward to put on prior to use. Also, most prior art items usually have only one specialised use, and thus require special carrying by the mother in preparation for breastfeeding in public. Consequently, there is a tendency not to use the prior art items as they are inconvenient to carry, along with all of the other equipment considered necessary for babies.

SUMMARY OF THE INVENTION

The invention reduces difficulties and disadvantages of the prior art by providing a blanket which can be used as a normal blanket for providing warmth, but also has means to provide privacy for the mother when nursing, and also to act as a sunshade or windshade for the baby by itself. The invention does not interfere with normal use of the blanket, and thus there is no additional disadvantage in using the blanket as a normal blanket. When required to provide privacy for breastfeeding in public, the blanket can be easily converted from a normal blanket to the nursing blanket by the mother alone, and can easily embrace the baby and herself.

The blanket according to the invention has a periphery, an inner portion, contracting means and margin means. The contracting means is for contracting the inner portion to form a hood means when contracted, the contracting means being spaced inwardly from the periphery. The margin means extend between the contracting means and the periphery and is adapted to form gathers or folds extending from and around the hood means when the contracting means is contracted.

A detailed disclosure following, related to drawings, describes a preferred embodiment of the invention which is capable of expression in structure other than that particularly described and illustrated.

DETAILED DISCLOSURE

FIG. 1

Figure 1:
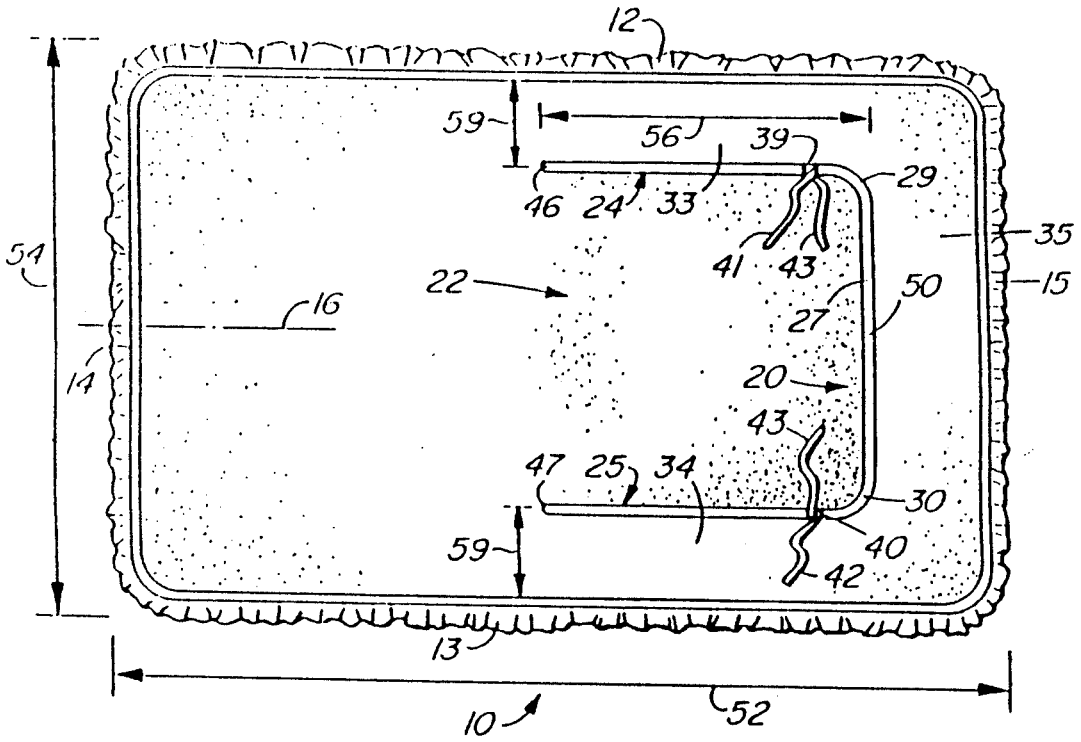
FIG. 1 is a plan view of a blanket of the invention in which a drawstring thereof is slack and the blanket is generally flat.

A blanket 10 according to the invention has a generally rectangular shaped periphery having parallel side edges 12 and 13 and parallel end edges 14 and 15 respectively. The blanket is of a typical baby blanket size, and is made from a soft, warm flexible fabric. The blanket has a central longitudinal axis 16 spaced equally from the side edges 12 and 13 and extending between the end edges 14 and 15.

The blanket also has a drawstring tube or sleeve 20 extending partially around an inner portion 22 of the blanket to define in part the inner portion. The drawstring sleeve 20 has first and second side portions 24 and 25 spaced equally from the longitudinal axis 16, and an interconnecting portion 27 extending smoothly through generous radii 29 and 30 adjacent inner ends of the side portions. The side portions are parallel to the longitudinal axis and disposed as mirror images of each other on opposite sides of the longitudinal axis as shown. The interconnecting portion 27 is generally perpendicular to the side portions and the radii 29 and 30 are curved inwards from the side portions towards the axis 16 to form a generally flat-bottomed U-shaped drawstring sleeve.

First and second margin portions 33 and 34 extend between the first and second side portions 24 and 25 of the drawstring sleeve 20 and the side edges 12 and 13 respectively of the periphery. Similarly, an interconnecting margin portion 35 extends between the interconnecting portion 27 of the drawstring sleeve and the end edge 15. It can be seen that the drawstring sleeve 20 is generally U-shaped with a flat bottom, and provides a corresponding similar U-shaped margin means, namely the portions 33, 34 and 35 extending between adjacent portions of the periphery and the drawstring sleeve.

The first and second side portions 24 and 25 of the drawstring sleeve have first and second string openings 39 and 40 located generally adjacent the radii 29 and 30 respectively of the side portions. The sleeve contains a drawstring which is preferably in three portions, namely first, second and third string portions 41, 42 and 43 respectively which are passed along the drawstring sleeve as follows. The first and second string portions 41 and 42 extend through the first and second portions 24 and 25 of the sleeve and pass through the first and second openings respectively. The first and second string portions have inner ends 46 and 47 which are secured adjacent opposite outer ends of the first and second side portions 24 and 25 respectively. The third string portion 43 extends along the interconnecting portion 27 of the sleeve to pass through the first and second openings 39 and 40 as shown. Preferably the third string portion has a middle portion 50 secured adjacent a middle portion of the interconnecting portion 27. Opposite ends of the third string portion 43 extend outwardly adjacent ends of the string portions 41 and 42, so that two string portions pass through each string opening 39 and 40 to permit easy tying together. When the drawstrings are slack they should extend about 6 inches (15 cm.) from the opening to reduces chances of tangling.

The blanket 10 is of a size typical for baby blankets, and thus has a length 52 of between 45 inches and 54 inches (115–138 cm.), and a width 54 of between 32 inches and 40 inches (80–102 cm.). The side portions 24 and 25 of the sleeve have equal lengths 56 of between 20 inches and 30 inches (50 76 cm.) depending on the blanket length, and are equally spaced from the axis 18 by the interconnecting portion 27 having a length of between 15 inches and 20 inches (38–51 cm.). These dimensions provide margin portions 33 and 34 with equal widths 59 of between about 6 inches and 8 inches (15–20 cm.). The interconnecting margin portion 35 has a width 60 of between about 6 inches and 8 inches (15–20 cm.).

Clearly, when the drawstrings are slack within their corresponding sleeve portions, the blanket is generally flat and has nominal dimensions as shown and functions as a normal blanket. When adjacent portions of the drawstrings are drawn from their corresponding drawstring sleeve portions and tied together, shape and size of the blanket changes as will be described for the particular purpose of the invention.

OPERATION

Figure 2:
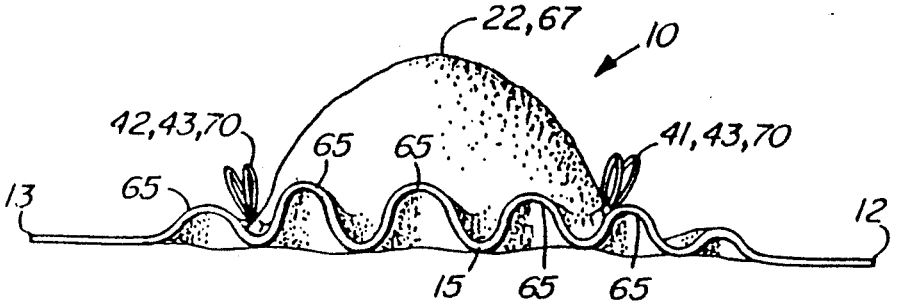
FIG. 2 is a simplified end elevation of the blanket when the drawstring is tightened.
Figure 3:
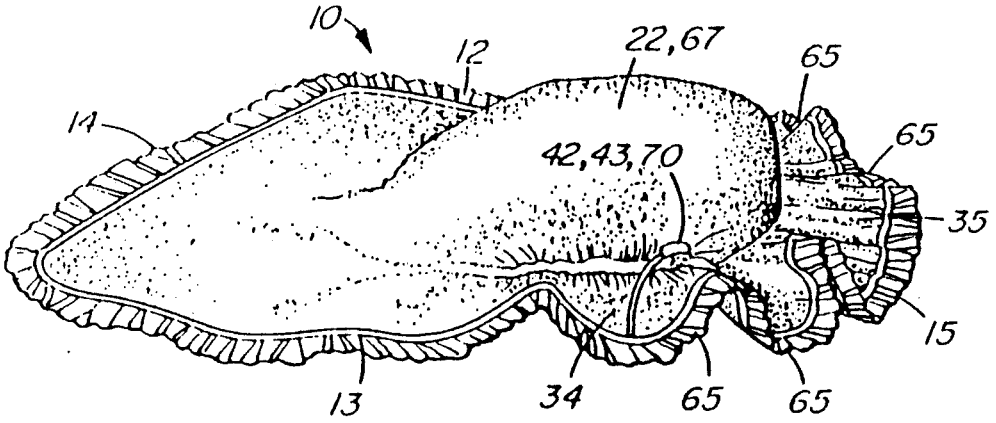
FIG. 3 is a simplified side perspective of the blanket when the drawstring is tightened.
Figure 4:
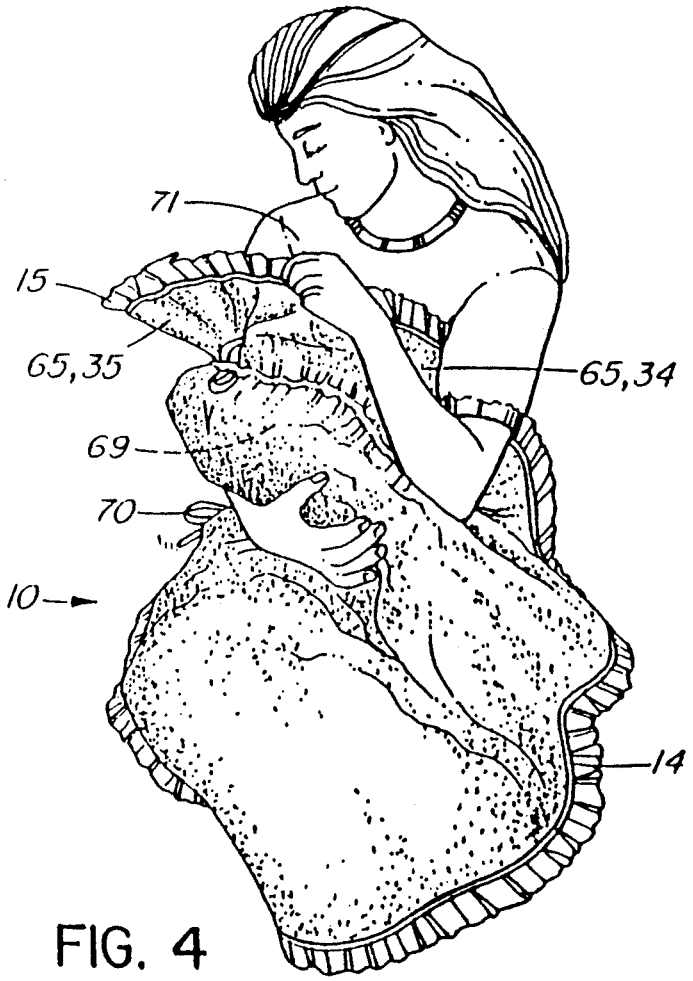
FIG. 4 is a simplified perspective showing a mother nursing a baby covered by the blanket.

FIGS. 2, 3 and 4

When the drawstrings 41, 42 and 43 are drawn through the respective openings 39 and 40 of the side portions 24 and 25 of the sleeve, the side portions and the interconnecting portion 27 are shrunken or contracted, thus distorting the shape of the blanket to reduce effective length of the drawstring sleeve. This forms a curved hood means or enclosure portion 67 in the inner portion 22 and extending between the portions 24, 25 and 27. This contraction of the length of the drawstring sleeve also effectively shortens the inner peripheries of the three margin portions 33, 34 and 35, but clearly lengths of the edges 12, 13 and 15, which define the outer peripheries of the margin portions remain essentially unchanged. These differences in lengths of the peripheries of the margin portions causes gathers 65 to form in the margin portions 33, 34 and 35 as shown.

The drawstrings 41, 42 and 43 are drawn through their respective openings until the enclosure or hollow portion 67 forms a hood means of sufficient size to snugly enclose the baby's head and torso, shown partially in broken outline generally at 69 in FIG. 4. The adjacent ends of the strings 41 and 43, and 42 and 43 can be secured with double bows 70 so as to hold the inner portion 22 in the hood shape, thus resisting any tendency of the blanket to fall from the baby's head and torso. The gathers 65 extend in a fan-like manner outwardly from the baby's head and torso, and cover portions of the upper body 71 of the mother adjacent the baby. Thus, if the mother has removed or loosened portions of her clothing for nursing, the gathers of the blanket extend to cover exposed portions of her body, providing privacy while nursing. Clearly, the fabric of the blanket is selected so as to have sufficient stiffness when the gathers are formed in the margin portions to permit the margin portions to be essentially self-supporting when leaning against the mother.

It can be seen that the drawstring sleeve 20 and the string portions 41, 42 and 43 serve as contracting means for contracting the inner portion 22 to form in the surrounding margin means gathers or folds extending from and around the hood means 67 when contracted. Clearly the contracting means are spaced inwardly from the periphery of the margin means sufficiently to provide the margin portions of adequate width which have gathers when the contracting means are contracted.

ALTERNATIVES

The contracting means is shown as the drawstring sleeve 20 and three drawstring portions 41, 42 and 43. Clearly, the drawstring could be in one or two portions, but this could likely be more combersome and could result in long lengths of string when contracted. Other contracting means can be used, for example a length of stretched elastic material could be secured around inner edges of the margin portions to form the gathers. While this alternative provides a permanent hood and gathers in the blanket, because the elastic is sewn to the fabric in a stretched condition, the blanket has a permanent shape for nursing, and thus does not function equally as well as a normal blanket as in the drawstring embodiment described previously.

Clearly, other types of contracting means can be substituted which would provide the advantages of the present invention wherein the inner edge of the margin portions can be contracted, which generates folds in the margin portions which increase stiffness of the margin portions to provide privacy for the mother, and provide a hood to enclose the baby.

The contracting means is shown to be a generally flat-bottom U-shape which could enclose the full length of the baby's torso and head. If a shorter C-shaped contracting means were substituted, the baby's head with adjacent portions only of the upper torso would be enclosed by the hood means, while remaining flat portions of the blanket would cover the baby.

The invention can also function as a sunshade and windshade when the baby is unattended. When the hood means and margin portions are correctly positioned on the baby, the baby's face can be sheltered from sun and wind without closely covering the face, which is more pleasant for the baby.

I claim:

1. A blanket having:

(a) a periphery defined by oppositely located side edges and oppositely located end edges, the periphery surrounding an inner portion of the blanket, (b) a generally C-shaped or U-shaped contracting means for contracting the inner portion to form a hood means when contracted, the contracting means being spaced inwardly from the periphery, the contracting means having the first and second side portions and interconnecting portion, the side portions being laterally spaced apart and having respective inner and outer ends, the interconnecting portion interconnecting the adjacent inner ends of the side portions and being located generally adjacent one end edge of the blanket, the outer ends of the side portions being located remotely from both end edges so as to provide a remaining portion of the blanket adjacent an end edge of the blanket opposite to the interconnecting portion free of the contracting means, (c) margin means extending between the contracting means and the periphery, the margin means being adapted to form gathers extending from and around the hood means when the contracting means is contracted, the gathers being sufficient to increase effective stiffness of the margin means to enable the margin means to form a generally self-supporting brim extending partially around the hood means.

2. A blanket as claimed in claim 1, in which the contracting means includes:

(a) a sleeve extending around an inner edge of the margin portion, (b) a drawstring means within the sleeve, the drawstring means having an inner end connected to the blanket and an outer end extending from the sleeve.

3. A blanket as claimed in claim 1, in which the contracting means includes:

(a) a length of stretched elastic material secured around an inner edge of the margin portion to form gathers.

4. A blanket as claimed in claim 1, in which:

(a) the blanket has a central longitudinal axis extending between the opposite end edges of the blanket, and spaced generally equally from the opposite side edges of the blanket, (b) the two side portions are spaced equally from the longitudinal axis.

5. A blanket as claimed in claim 4, in which:

(a) the two side portions are parallel to the longitudinal axis and are disposed as mirror images of each other on opposite sides of the longitudinal axis, (b) the interconnecting portion passes adjacent an adjacent end edge to form a generally flat-bottomed U-shaped connecting means and correspondingly shaped margin means.

6. A blanket as claimed in claim 2, in which:

(a) the blanket has a central longitudinal axis extending between opposite end edges of the blanket, (b) the first and second side portions are spaced equally from the longitudinal axis, (c) first and second side portions of the sleeve of the contracting means have respective first and second openings located adjacent the inner ends of the side portions, (d) the drawstring has first, second and third string portions, the first and second string portions extending through the first and second portions of the sleeve respectively to pass through the first and second openings respectively, the third string portion extending along the interconnecting portion of the sleeve to pass through the first and second openings respectively.

7. A blanket as claimed in claim 6, in which:

(a) the first and second string portions have inner ends secured to the blanket adjacent the outer ends of the side portions, and have lengths longer than the side portions when extended, (b) the third string portion has a middle portion secured to the blanket adjacent a middle portion of the interconnecting portion of the sleeve, and has a length longer than the interconnecting portion when extended.

8. A blanket as claimed in claim 4, in which:

(a) the blanket is generally rectangular and has a length of between 45 inches and 54 inches (115–138 cm.), and a width of between 32 inches and 40 inches (80–102 cm.), (b) the margin means have margin portions having a width of between 6 inches and 8 inches (15–20 cm.), (c) the side portions of the contracting means have lengths of between 20 inches and 30 inches (50–76 cm.), (d) the interconnecting portion of the contracting means has a length of between 15 inches and 20 inches (38–51 cm.).

9. A blanket as claimed in claim 1, in which the margin means extending between the first and second side portions and adjacent side edges of the blanket, and between the interconnecting portion and an adjacent end edge have generally similar widths.

* * * * *